United States Patent [19]

Gerlach

[11] 3,943,398

[45] Mar. 9, 1976

[54] ELECTRONIC TUBE WITH CYLINDRICAL ELECTRODES

[75] Inventor: Pierre Gerlach, Paris, France

[73] Assignee: Thomson-CSF, Paris, France

[22] Filed: Dec. 17, 1974

[21] Appl. No.: 533,716

[30] Foreign Application Priority Data

Dec. 21, 1973 France ..... 73.46036

[52] U.S. Cl. ..... 313/341; 313/346 R; 313/348

[51] Int. Cl.[2] ..... H01J 1/15; H01J 19/08

[58] Field of Search ..... 313/341, 348, 340, 239, 313/313, 346

[56] References Cited

UNITED STATES PATENTS

| | | | |
|---|---|---|---|
| 2,289,588 | 7/1942 | Miller | 313/341 X |
| 2,928,978 | 3/1960 | Morton | 313/341 X |
| 3,287,597 | 11/1966 | Smith | 313/340 X |
| 3,449,616 | 6/1969 | Sarrois | 313/348 X |
| 3,742,292 | 6/1973 | Gerlach et al. | 315/39 |

*Primary Examiner*—Saxfield Chatmon, Jr.
*Attorney, Agent, or Firm*—Roland Plottel

[57] ABSTRACT

The present invention relates to an electronic tube with cylindrical electrodes. In tubes of this kind, where the cathode generally consisting of a wire mesh 1, the space located within same is tightly coupled with the other inter-electrode spaces of the tube. The invention, in order to avert parasitic resonances at the harmonics closest to the operating frequency, which can occur in said space in operation, provides for the arrangement in said space of a certain number of metal sleeves 8, 9 and 10 coaxial with the electrodes, constituting low-inductance coaxial line sections.

Application to high-power, short-wave (20 MHz) triodes for transmitting applications.

4 Claims, 1 Drawing Figure

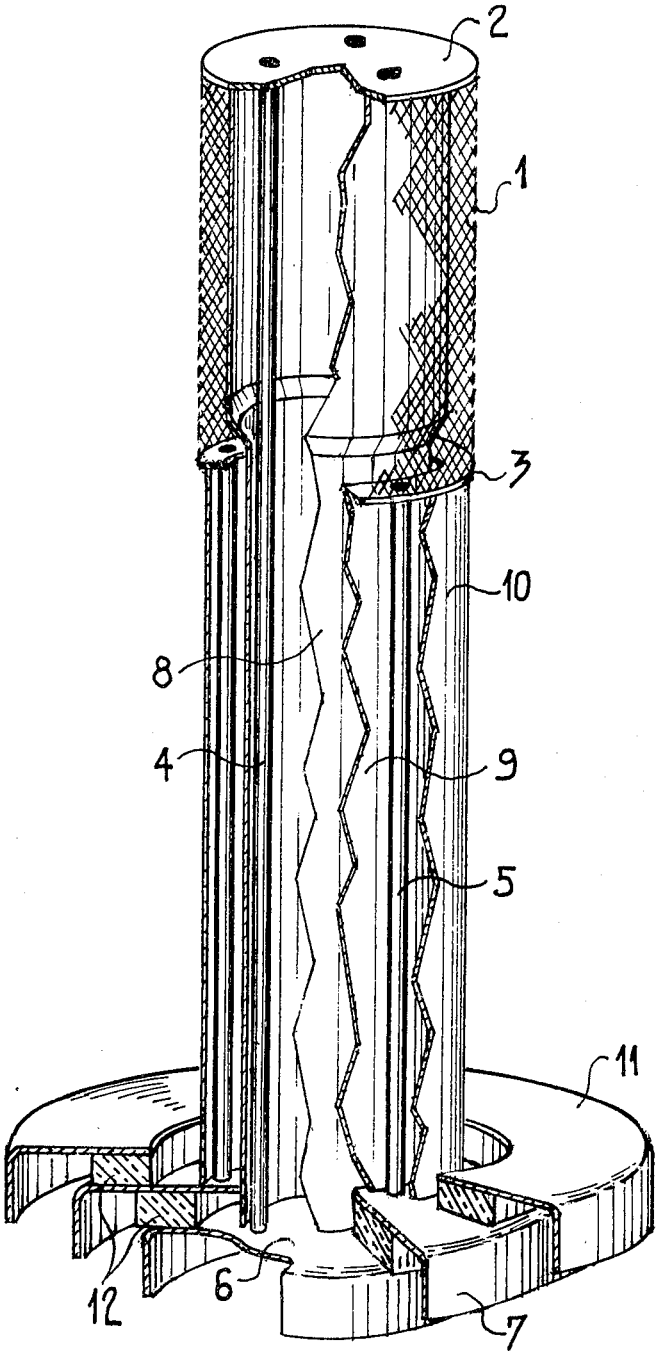
2
1
3
10
8
4
9
5
11
12
6
7

ELECTRONIC TUBE WITH CYLINDRICAL ELECTRODES

The present invention relates to a cylindrical electronic tube, in which the various electrodes, namely the cathode, the grid or grids, and the anode, which are cylindrical in shape, are arranged about a common axis, namely the axis of the tube.

In tubes exhibiting this kind of structure, and this applies to the majority of power tubes, triodes, tetrodes used for short-wave radio transmission purposes, the various electrodes define between one another resonant volumes. If, moreover, and this is frequently the case, the major part of the cathode, of cage-type, is constituted by spaced wires (the cathode will for example be a metal mesh coiled to form a cylinder) the space located inside the cathode will be tightly coupled with the other free spaces between the tube electrodes.

At certain operating frequencies and at certain power levels, this space will start to resonate due to the coupling effect. This is due in particular to the presence inside said space, of rods used for the double purpose of supporting the cathode and of the supplying the current required in order to heat it. These rods constitute lines which have a high inductance, so that said resonance can occur, if not at the tube operating frequency at any rate at one of the near harmonics thereof. It has to be added, where tubes of this kind are concerned, which are generally class C operated, that these harmonics are numerous and certain of them very strong.

Resonances of this kind are of course prejudicial to the proper operation of the tube due to the consequent power absorption in particular, and may in certain cases impair the tube life.

The object of the invention is a tube equipped with a cathode device which makes it possible to overcome these difficulties. In accordance with the invention, means associated with the cathode are provided in order to shift to a higher level the resonance frequencies of the space delimited by the cathode, so that these frequencies are effectively outside the range of the harmonics generated by the tube in operation, or in order, at any rate, to sufficiently raise the order of the harmonics involved in such resonance to ensure that, because of their low level, they cannot give rise to any serious difficulty in the operation of the tube.

The invention will be better understood from a consideration of the ensuing description and the attached single FIGURE, the latter illustrating by way of non-limitative example an embodiment of the cathode device in the tubes in accordance with the invention.

In the FIGURE, which is a cut-away perspective view, there can be seen a cylindrical cathode 1 constituted by a wire mesh, barium-coated tungsten for example; the mesh is attached at its ends, on the one hand to a bottom constituted by a metal disc 2 and on the other to a ring, likewise of metal, 3. To the disc and the ring there are attached two sets of metal rods, numbering three in each set in the example chosen, only one rod having been marked in each set: references 4 and 5. These rods are respectively in contact with metal dished components 6 and 7 which act as connections with the generator supplying the heating current; the generator has not been shown; fixed to these dished components, the rods serve to support the cathode.

In accordance with the invention, and as the FIGURE shows in fact, the cathode device comprises, furthermore, a hollow metal cylinder 8 attached to the base 2 and extending over the whole height of the rods 4, surrounding the latter and in contact with the dished component 6. It will be seen, furthermore, from the example shown in the FIGURE, that there are two cylinders 9 and 10, attached in each case, to one of the edges of the ring 3 and extending over the full height of the rods 5 up to the dished components 7 with which they are in contact. The rods 5 are located inside the cylindrical ring delimited by the two cylinders 9 and 10. In the FIGURE, 11 illustrates the dished component connecting the grid of the tube, which grid, in order not to overburden the drawing, has not been shown, whilst 12 illustrates the insulating spacers. The cylinders 8, 9 and 10 will for example be constituted by foils of a refractory metal, molybdenum or tantalum for example, which have been wrapped and welded; in addition, they will for example be spot-welded to the dished components, to the bottom and to the ring and can in this case be equipped with flat flanges to simplify welding.

The construction of these sleeves 8, 9 and 10 and their fitting in position, are carried out in a general way in accordance with the prior art methods employed in electronic tubes, the detail of which requires no discussion here since it is of no importance from the point of view of the invention.

This construction is, furthermore, open to several variations only one of which has been described. In this variation, the metal foil cylinders, numbering three altogether, 8, 9, 10 and extending over the full height of the rods, are attached at both their ends to components of the tube. However, it goes without saying that arrangements differing from those described here, both in terms of the material of which the cylinders are made and in terms of their number, their shape and their dimensions, are possible in order to achieve the same end and an equivalent effect, and the choice of the arrangement will depend upon the specific conditions applying to each tube. All these variant embodiments are within the scope of the invention.

By means of these sleeves, there are created inside the cathode a certain number of sections of low-inductance coaxial line, whose resonant frequencies, because of the low inductance, are, other things being equal, those of high order harmonics of the operating frequency of the tube.

Thus, triodes and tetrodes for transmitter applications, operating in the range from 3 to 26 megahertz, at various levels up to 500 kilowatts, have been built, which do not exhibit the drawbacks of equivalent prior art tubes.

Of course, the invention is not limited to the embodiment described and shown which was given solely by way of example.

What is claimed, is:

1. An electronic tube with cylindrical electrodes constituted by cylinders arranged around a common axis, the cathode of which, constituted by a metal mesh wrapped to form a cylinder fixed at one of its ends to a metal disc and at the other end to a ring, is supported by two sets of rods, the rods of one of said sets being fixed at one of their ends to said metal disc and at the other ends to a first support parallel to said metal disc, and the rods of the other set being fixed at one of their ends to said ring and at the other ends to a second support parallel to the first support, characterised in that the tube comprises sleeves numbering at least three altogether, one sleeve, attached to said metal disc and to said first support, surrounding the rods of the first set, and the two other sleeves, fixed to said ring and to said second support, and disposed to either opposite sides of the rods of the second set.

2. An electronic tube as claimed in claim 1, characterised in that said sleeves are made of rolled metal foils.

3. An electronic tube with cylindrical electrodes constituted by cylinders arranged around a common axis, the cathode of which, constituted by a metal mesh, is wrapped to form a cylinder attached at one of its ends to a top disc and at the other end to a ring, and is supported by a first set of rods, secured to said top disc and to a first support parallel to said disc, and by second set of rods secured to said ring and to a second support parallel to said ring, characterised in that the tube it comprises coaxial sleeves numbering three, arranged around said axis, one of which extends from said top disc to said first support with the rods of said first set located within, and in that the two other sleeves extend from said ring to said second support with said second set located between said two sleeves.

4. An eletronic tube as claimed in claim 3, characterised in that said sleeves are made of rolled metal foils.

* * * * *